United States Patent [19]

Mayne

[11] Patent Number: 4,796,765

[45] Date of Patent: Jan. 10, 1989

[54] PERMANENT MAGNET TRANSPORTER

[75] Inventor: Jimmy Mayne, Goshen, Ohio

[73] Assignee: Chase Industries, Inc., Cincinnati, Ohio

[21] Appl. No.: 92,048

[22] Filed: Sep. 2, 1987

[51] Int. Cl.[4] ..... B66C 17/00

[52] U.S. Cl. ..... 212/205; 212/271

[58] Field of Search ..... 212/205, 271; 105/148; 104/281, 283; 180/164, 167–169

[56] References Cited

U.S. PATENT DOCUMENTS

| | | | |
|---|---|---|---|
| 3,791,309 | 2/1974 | Baermann | 104/283 |
| 3,927,620 | 12/1975 | Clapham | 104/283 |
| 4,142,469 | 3/1979 | Polgreen | 104/283 |
| 4,284,010 | 8/1981 | Marshall | 105/148 |
| 4,462,316 | 7/1984 | Tupper | 105/148 |
| 4,641,757 | 2/1987 | Rosendale | 212/205 |

*Primary Examiner*—Sherman D. Basinger
*Assistant Examiner*—Stephen P. Avila
*Attorney, Agent, or Firm*—Frost & Jacobs

[57] ABSTRACT

A permanent magnet transporter for use with a magnetizable structure having a horizontal downwardly facing supporting surface, the transporter comprising a frame member having upper and lower surfaces, a plurality of bipolar permanent magnets on the upper surface of the frame member having planar upper surfaces in close proximity to but not contacting the supporting surface, a plurality of rollers mounted on the upper surface of the frame member and projecting upwardly into contact with the supporting surface to permit movement of the transporter in any direction across the supporting surface, and a block and tackle assembly or its equivalent connected to the lower surface of the frame member for attachment to and support of a load.

10 Claims, 2 Drawing Sheets

PERMANENT MAGNET TRANSPORTER

BACKGROUND OF THE INVENTION

This invention relates to a transporter having permanent magnets for use in combination with an iron or steel sheet ceiling or similar structure having a horizontal, downwardly facing supporting surface, the transporter also having a plurality of rollers contacting the ceiling or supporting surface and permitting free movement of the transporter in any direction across the ceiling or supporting surface, and means depending from a frame member of the transporter for attachment to and support of a load.

The use of electromagnets for lifting and transporting magnetic material such as coiled steel strip is well known in the prior art. In such structures an electromagnet is generally suspended at the end of lifting means, such as a block and tackle, from a frame structure on tracks in a single direction. U.S. Pat. Nos. 2,220,561; 2,651,538 and 2,946,616 are representative of structures of this type.

U.S. Pat. No. 2,220,561, issued November 1940 to Ward, discloses an electromagnet for lifting coiled steel strip. The electromagnet is mounted on a yoke or body, and the magnet produces a ring-shaped flux distribution with lines of force extending generally around a central axis above and radially thereof so that greater efficiency is obtained in lifting annular shapes. A chain and hook are suspended beneath the electromagnet for carrying a selected load.

U.S. Pat. No. 2,651,538, issued September, 1953 to Stahmer, shows an electromagnet used to pick up heavy materials. A plurality of magnetic units is mounted in an outer casing. Hooks are provided to engage a desired load. Housings pivot about pins.

U.S. Pat. No. 2,946,616, issued July, 1960 to Carter et al, discloses an electromagnetic lifting device especially adapted for lifting coils of steel strip. An electromagnet is mounted in a housing. Rollers are mounted on a post and engage the upper face of a lower wall. A spreading member is carried by a plunger and a plurality of fingers. The fingers can be shifted from a nested position to positions separated from each other and away from the lower end portion of the plunger. Movement of the fingers is effected by the rollers.

U.S. Pat. No. 2,426,795, issued September, 1947 to Sjostrom, discloses a magnetic floor sweeper adapated to pick up magnetizable scraps or small pieces such as nuts, screws, bolts and metal shavings which may be on floors or work benches. A permanent magnet is mounted on a base frame. A centrally located opening or recess is provided between a non-magnetic plate and the floor. The sweeper is mounted on a plurality of casters and may be pushed in any desired direction.

While it is evident that the prior art has disclosed the use of magnets in a lifting device for picking up magnetizable material, to the best of applicant's knowledge there is no suggestion of the use of bipolar permanent magnets for the purpose of holding a transporter to a magnetizable metal ceiling and at the same time permitting movement of the transporter in any desired direction across the ceiling.

It will be recognized that free movement of a transporter in any desired direction, e.g. in a building, loading dock, or truck body, is highly advantageous and facilitates the handling and transporting of loads. Such a transporter will automatically center itself over a load to be lifted as soon as the means for attachment to the load is placed under tension. The use of permanent magnets obviates the need for connection to a source of electric current which is of course required for electromagnets.

SUMMARY OF THE INVENTION

It is an object of the invention to provide a transporter of simple construction having the above advantageous features.

According to the invention there is provided a magnetic transporter for use with an iron or steel sheet structure having a horizontal downwardly facing supporting surface, said transporter comprising a frame member having upper and lower surfaces, a plurality of bipolar permanent magnets mounted on the upper surface of said frame member so as to project upwardly therefrom and having planar upper surfaces in close proximity to but not in contact with said supporting surface, a plurality of rollers mounted on said upper surface of said frame member and projecting upwardly therefrom into contact with said supporting surface, said rollers permitting movement of said transporter in any direction across said supporting surface, and means connected to the lower surface of said frame member for attachment to and support of a load.

Ordinarily the supporting surface of iron or steel sheet is a ceiling in a building, loading dock, or truck body. It is of course necessary that the ceiling be capable of supporting the load to be lifted since the weight thereof is transmitted to the ceiling through the magnetic transporter.

DETAILED DESCRIPTION OF THE INVENTION

Figure 1:
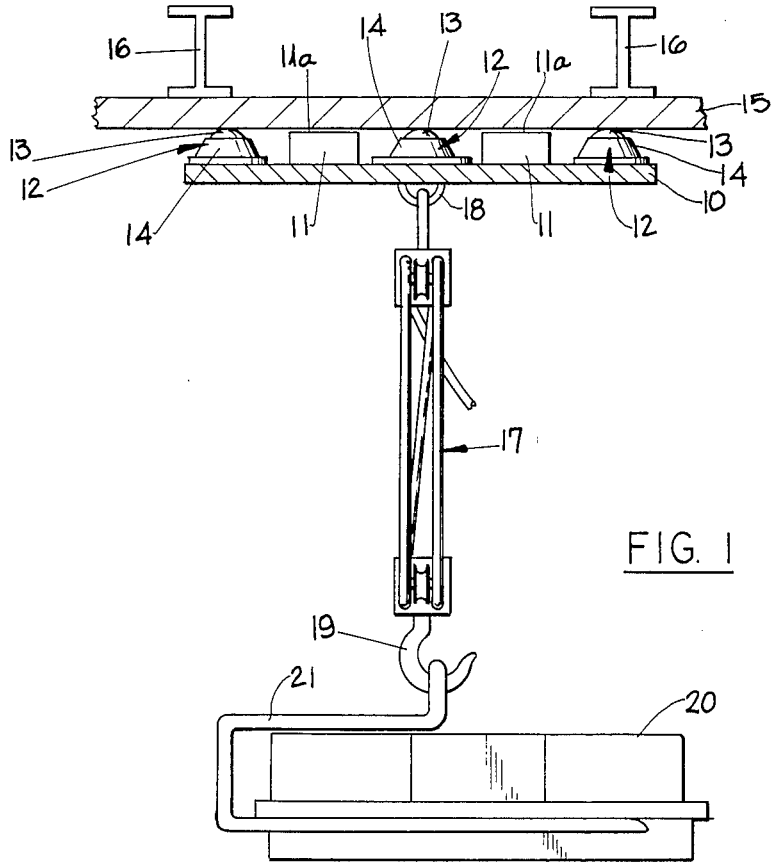
FIG. 1 is a diagrammatic side view, partially in section, of a magnetic transporter embodying the invention in position on an iron or steel sheet ceiling.
Figure 2:
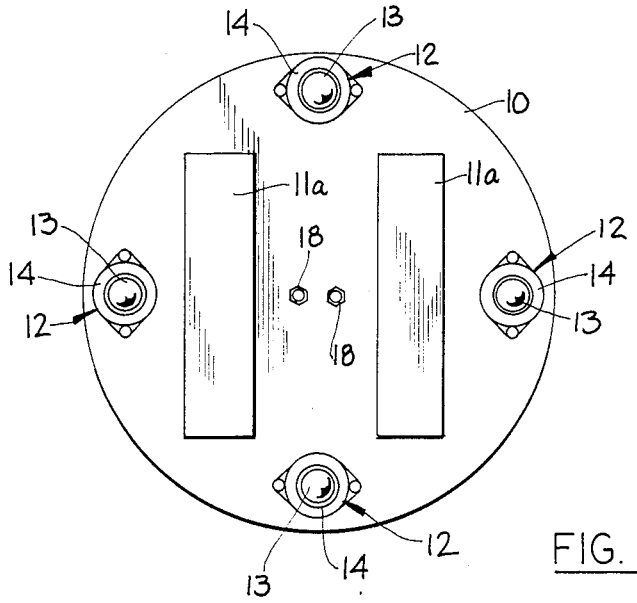
FIG. 2 is a top view of the transporter of the invention.

Referring to FIGS. 1 and 2 of the drawing, a magnetic transporter assembly embodying the invention includes a frame member 10 having upper and lower surfaces, which is of non-magnetic material and preferably is formed from aluminum, although substantially rigid plywood or similar material could be used. Mounted securely on the upper surface of frame member 10 is a plurality of bipolar permanent magnets 11 having planar upper surfaces 11*a*. By way of non-limiting example, bipolar ceramic magnets can be used and are commercially available with varying degrees of magnetic force. Other types of bipolar permanent magnets are also satisfactory.

A plurality of rollers or casters is also securely mounted on the upper surface of frame member 10 as indicated generally at 12. These rollers are of known type and comprise a rotatable ball 13 mounted in a base or socket member 14. Such rollers permit movement in any direction.

As shown in FIG. 1, the assembly of frame member 10, bipolar permanent magnets 11 and rollers 12 is adapted to contact and depend downwardly from a horizontal supporting surface of iron or steel sheet or other magnetizable material indicated at 15. The support surface 15 will be secured to a ceiling of a building, loading dock, truck body or the like in conventional manner, as by a series of I-beams indicated at 16. As stated previously, the attachment of supporting surface 15 to other structural parts of a building must be of sufficient strength to withstand the weight of a load to be lifted.

The rollers 12 projecting upwardly from frame member 10 into contact with supporting surface 15 are so arranged as to position the planar upper surfaces 11*a* of the permanent magnets in close proximity to but not in contact with the supporting surface 15, in order to permit free and easy movement of the rollers in any direction, while also minimizing loss of magnetic force. In an exemplary arrangement, it has been found that a slight clearance ranging from about 1/64 inch to about ⅛ inch between the planar upper surfaces 11*a* and the downwardly facing supporting surface 15 is satisfactory and retains most of the magnetic force of the magnets.

The magnetic transporter or hoist of the invention further includes means indicated generally at 17 connected to the lower surface of frame member 10 for attachment to and lifting of a load. A conventional block and tackle assembly is illustrated in FIG. 1 as an exemplary means. Equivalent means could be substituted, and it is preferred to utilize means which will provide a mechanical advantage of about 2:1 to 4:1, in order to permit manual lifting of relatively heavy loads. The block and tackle assembly or other lifting means is attached securely to the lower surface of frame member 10 for swiveling movement, as by a U-shaped rod or hook 18.

Figure 3:
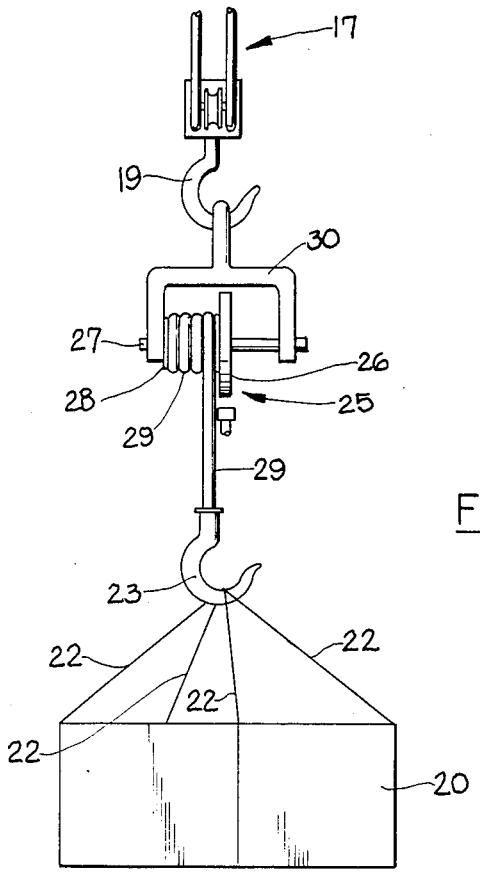
FIG. 3 is a fragmentary view of the lower portion of the transporter of the invention illustrating an optional overload release device.

At the lowermost end of the block and tackle assembly 17 a coupling device such as a hook 19 is provided for engagement with a load 20 to be lifted. By way of illustration, FIG. 1 shows a palletized load 20 which may be engaged by an element 21 having a configuration which will permit it to slide underneath a pallet and to locate the lifting means 17 approximately over the center of gravity of the load 20 when it is lifted. An alternative arrangement is shown in FIG. 3 where straps or ropes 22 are provided encircling the load 20 and engaged by an auxiliary hook 23.

As shown in FIG. 2, the rollers 12 and permanent magnets 11 are preferably arranged symmetrically on the upper surface of frame member 10 so that the forces will be uniformly distributed when a load is lifted. Although FIG. 2 indicates that frame member 10 is circular, it will be apparent that the frame member could be square, hexagonal or rectangular if desired. The preferred structure for the frame member is a planar and imperforate panel having sufficient rigidity to prevent deformation when subjected to the stress of lifting a load.

Referring again to FIG. 3, an optional overload safety device is shown, indicated generally at 25, interposed between the lifting means 17 and load to be lifted which will release the load before it is lifted clear of a surface on which it is supported if the load exceeds the nominal capacity of the permanent magnets. For example, if the magnets have a capacity of supporting or lifting about 550 pounds, and if a load should happen to exceed this weight, it would be desirable to provide a releasable safety device adjacent the load rather than to have the transporter of the invention pulled loose from the ceiling 15 on which it is supported. By way of non-limiting example, safety device 25 is shown as comprising a brake 26 non-rotatably mounted on a horizontal shaft 27, with a reel 28 also non-rotatably mounted on shaft 27. A chain or rope 29 is engaged in reel 28 and connected to auxiliary hook 23. The arrangement is such that if the weight of load 20 exceeds a predetermined maximum torque set in brake 25 (e.g., 500 pounds), the brake will rotate along with shaft 27 and reel 28, thus paying out chain or rope 29 as lifting means 17 is raised. Shaft 27 is rotatably journaled in a bifurcated member 30 which is also provided with means to engage hook 19. It will be understood that equivalent overload safety devices may be substituted, such as coil springs, a friction clutch, ratchet and pawl device, or the like.

While the invention has been described in an embodiment more or less specific to lifting and moving loads, its utility is not so limited, and other uses will be apparent to those skilled in the art which are within the embodiments of the invention. Accordingly, modifications of the apparatus specifically described herein may be made without departing from the spirit and scope of the invention, and it is to be understood that no limitations on the invention are to be inferred except as set forth in the appended claims.

I claim:

1. A permanent magnet transporter for use with an iron or steel sheet structure having a horizontal downwardly facing supporting surface, said transporter comprising a frame member having upper and lower surfaces, a plurality of bipolar permanent magnets mounted on the upper surface of said frame member so as to project upwardly therefrom and having planar upper surfaces in close proximity to but not in contact with said supporting surface, a plurality of rollers mounted on said upper surface of said frame member and projecting upwardly therefrom into contact with said supporting surface, said rollers permitting movement of said transporter in any direction across said supporting surface, and means connected to the lower surface of said frame member for attachment to and support of a load.

2. The transporter claimed in claim 1, wherein said supporting surface is a ceiling.

3. The transporter claimed in claim 1, wherein said rollers project upwardly beyond said planar upper surfaces of said magnets by a distance sufficient to provide slight clearance between said planar upper surfaces of said magnets and said supporting surface.

4. The transporter claimed in claim 3, wherein said clearance between said planar upper surfaces of said magnets and said supporting surface ranges from about 1/64 inch to about ⅛ inch.

5. The transporter claimed in claim 1, wherein said frame member is of non-magnetic material.

6. The transporter claimed in claim 1, wherein said magnets are bipolar ceramic magnets.

7. The transporter claimed in claim 1, wherein said means for attachment to a load includes a block and tackle assembly for lifting said load.

8. The transporter claimed in claim 7, wherein said means for attachment to a load includes an overload safety device beneath said block and tackle assembly which is adapted to release said load before it is lifted clear of a surface on which it is supported if said load exceeds a predetermined nominal capacity of said magnets.

9. The transporter claimed in claim 1, wherein said frame member is formed from substantially rigid aluminum to which said magnets and said rollers are rigidly connected.

10. The transporter claimed in claim 9, wherein said frame member is substantially planar and imperforate.

* * * * *